US011376483B1

(12) United States Patent
Prewitt

(10) Patent No.: US 11,376,483 B1
(45) Date of Patent: Jul. 5, 2022

(54) PICKLEBALL PRACTICE DEVICE

(71) Applicant: Rigardo Prewitt, Chicago, IL (US)

(72) Inventor: Rigardo Prewitt, Chicago, IL (US)

( * ) Notice: Subject to any disclaimer, the term of this patent is extended or adjusted under 35 U.S.C. 154(b) by 0 days.

(21) Appl. No.: 17/384,997

(22) Filed: Jul. 26, 2021

(51) Int. Cl.
*A63B 71/00* (2006.01)
*A63B 60/58* (2015.01)
*A63B 102/08* (2015.01)

(52) U.S. Cl.
CPC ..... *A63B 71/0045* (2013.01); *A63B 60/58* (2015.10); *A63B 2102/08* (2015.10)

(58) Field of Classification Search
CPC . A63B 71/0045; A63B 60/58; A63B 2102/02; A63B 2102/08; A45C 2003/007
USPC ..... 248/461
See application file for complete search history.

(56) References Cited

U.S. PATENT DOCUMENTS 2,767,758 A 10/1956 Haynes
3,814,422 A * 6/1974 Girden ..... A63B 67/04 473/435
4,193,495 A * 3/1980 Keeley ..... A63B 71/0045 294/143
4,262,798 A * 4/1981 Raab ..... A63B 60/58 206/315.1
D322,886 S 1/1992 Pennington
5,224,602 A * 7/1993 Bettles ..... A63B 71/0045 206/579
5,695,067 A * 12/1997 Harvey ..... A63B 71/0045 206/579
6,234,442 B1 * 5/2001 Huang ..... A47B 97/08 211/195
6,264,161 B1 * 7/2001 Waggoner ..... A47B 19/002 248/188.6
6,293,511 B1 * 9/2001 Shepherd ..... A47B 19/002 248/441.1
6,644,448 B2 * 11/2003 Bernbaum ..... A45C 3/00 190/111
7,473,183 B2 1/2009 McDuffee
7,712,752 B2 * 5/2010 Horning ..... A47B 81/00 280/47.19
D689,570 S 9/2013 Adema
9,072,653 B2 * 7/2015 Nemard ..... A61B 50/31
2012/0273540 A1 11/2012 Preston
2016/0136498 A1 5/2016 Jones
2017/0203176 A1 * 7/2017 Moros ..... G09B 19/0038
2019/0262680 A1 8/2019 Fiore
2019/0344148 A1 11/2019 Miller

* cited by examiner

*Primary Examiner* — Ko H Chan
(74) *Attorney, Agent, or Firm* — Kyle A. Fletcher, Esq.

(57) ABSTRACT

The pickle ball practice device is an item of sporting equipment. The pickle ball practice device is configured for use with pickle ball. The pickle ball practice device stores pickle ball equipment for transportation. The pickle ball practice device forms a backboard used for physical training in the sport of pickle ball. The pickle ball practice device comprises a pan structure, a lid structure, a hinge structure, a pedestal structure, and a fastening structure. The hinge structure secures the pan structure to the lid structure. The pedestal structure elevates the pan structure and the lid structure to elevate the backboard structure formed by the pickle ball practice device. The fastening structure secures the pan structure and the lid structure to a fence.

14 Claims, 8 Drawing Sheets

PICKLEBALL PRACTICE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports and physical training, more specifically, an item for storing and transporting sports equipment specially adapted for games played with rackets.

SUMMARY OF INVENTION

The pickle ball practice device is an item of sporting equipment. The pickle ball practice device is configured for use with pickle ball. The pickle ball practice device stores pickle ball equipment for transportation. The pickle ball practice device forms a backboard used for physical training in the sport of pickle ball. The pickle ball practice device comprises a pan structure, a lid structure, a hinge structure, a pedestal structure, and a fastening structure. The hinge structure secures the pan structure to the lid structure. The pedestal structure elevates the pan structure and the lid structure to elevate the backboard structure formed by the pickle ball practice device. The fastening structure secures the pan structure and the lid structure to a fence.

These together with additional objects, features and advantages of the pickle ball practice device will be readily apparent to those of ordinary skill in the art upon reading the following detailed description of the presently preferred, but nonetheless illustrative, embodiments when taken in conjunction with the accompanying drawings.

In this respect, before explaining the current embodiments of the pickle ball practice device in detail, it is to be understood that the pickle ball practice device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pickle ball practice device.

It is therefore important that the claims be regarded as including such equivalent construction insofar as they do not depart from the spirit and scope of the pickle ball practice device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
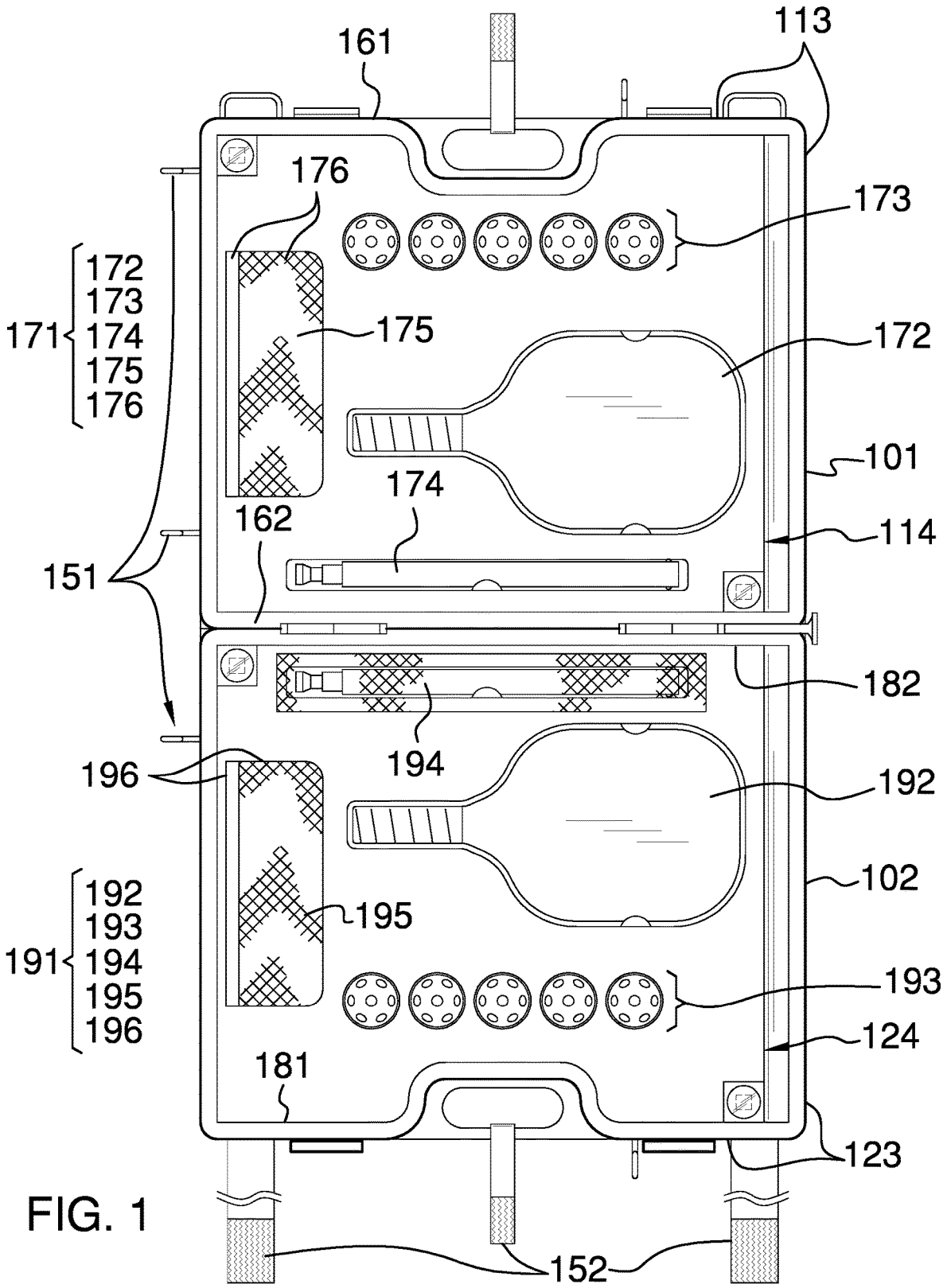
FIG. 1 is an open interior view of an embodiment of the disclosure.
Figure 2:
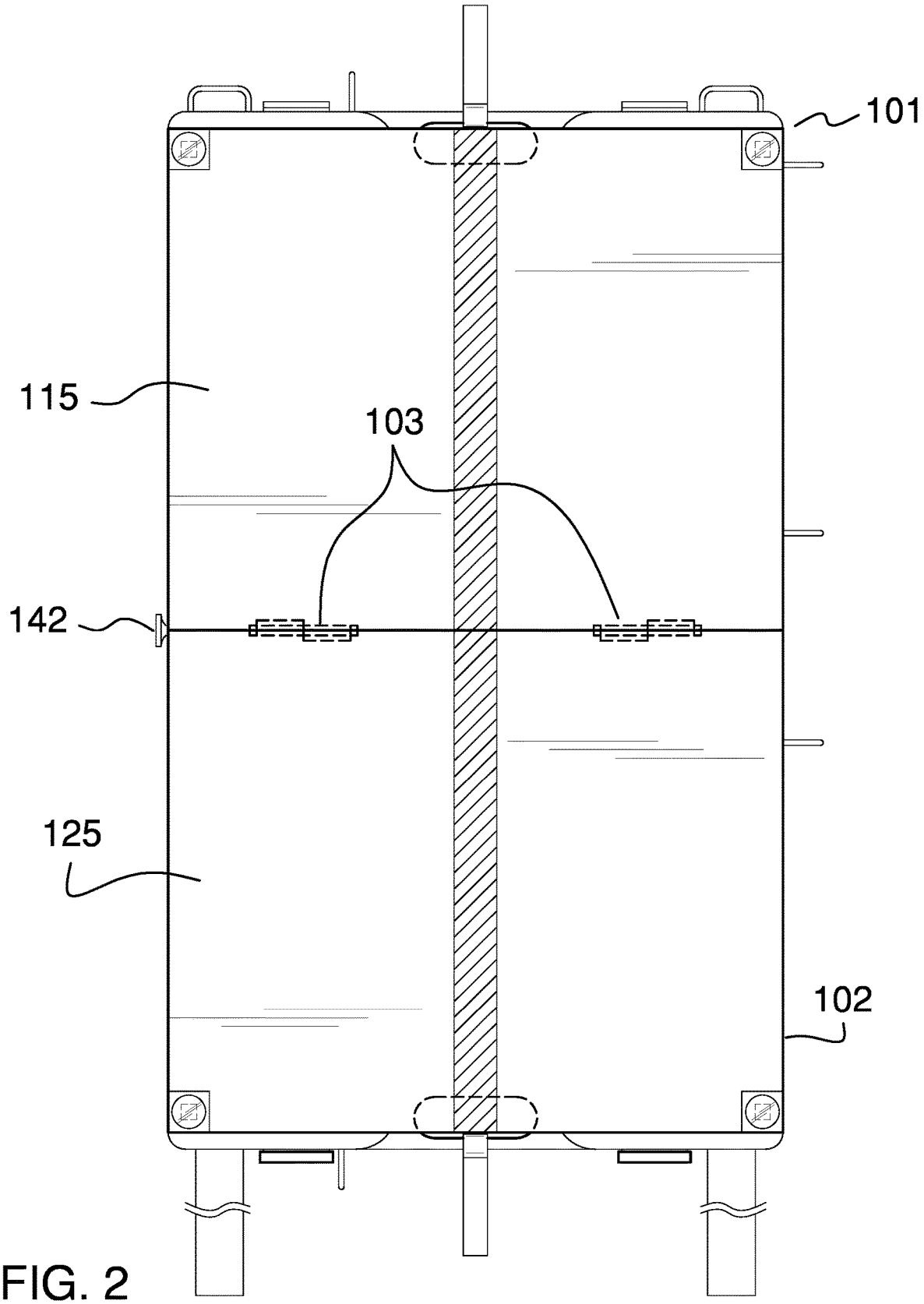
FIG. 2 is an open exterior view of an embodiment of the disclosure.
Figure 3:
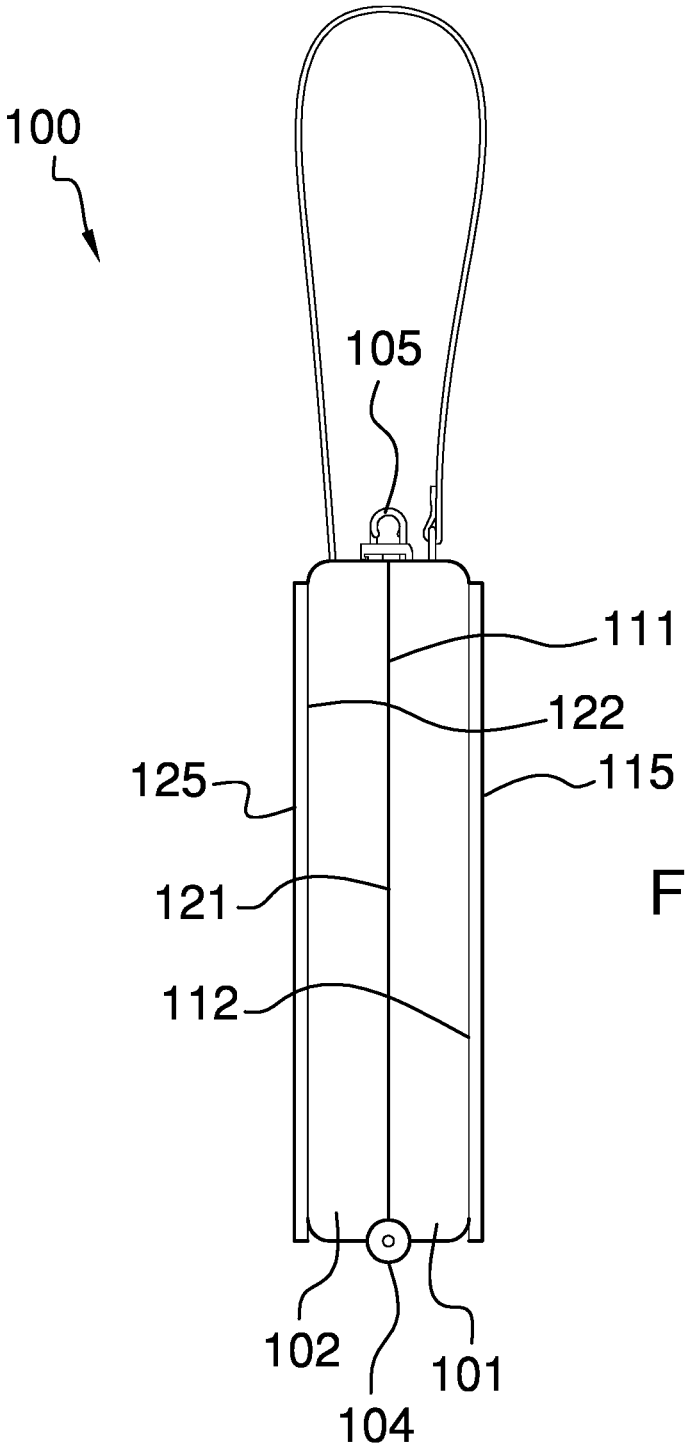
FIG. 3 is a closed side view of an embodiment of the disclosure.
Figure 4:
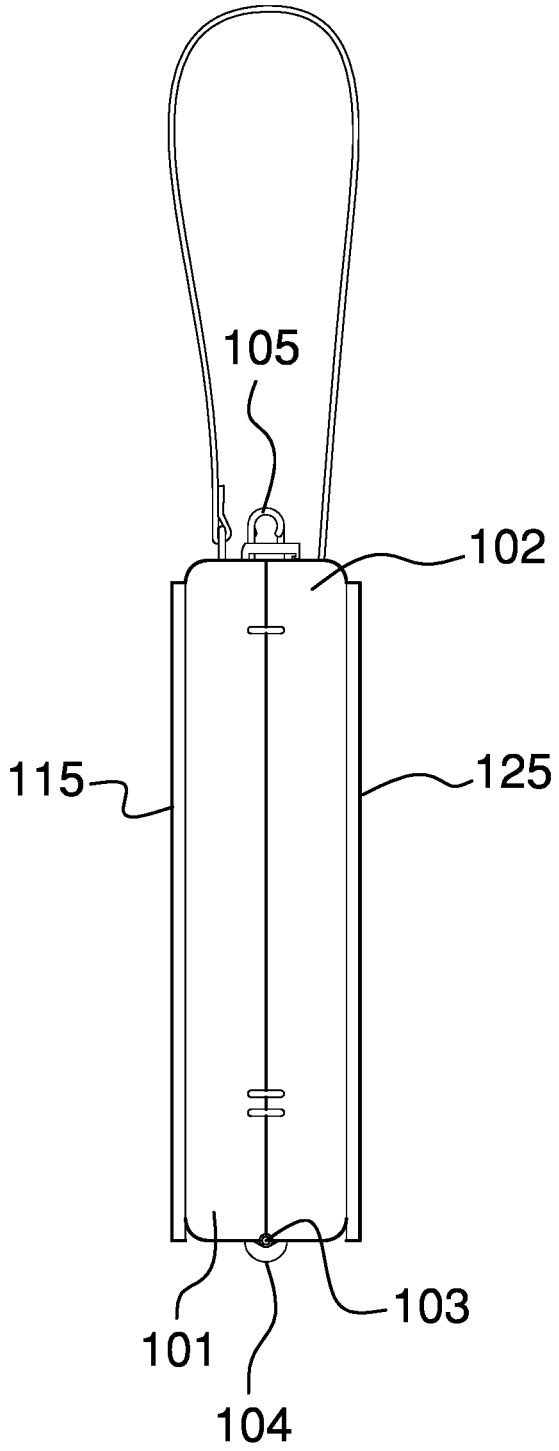
FIG. 4 is a closed reverse side view of an embodiment of the disclosure.
Figure 5:
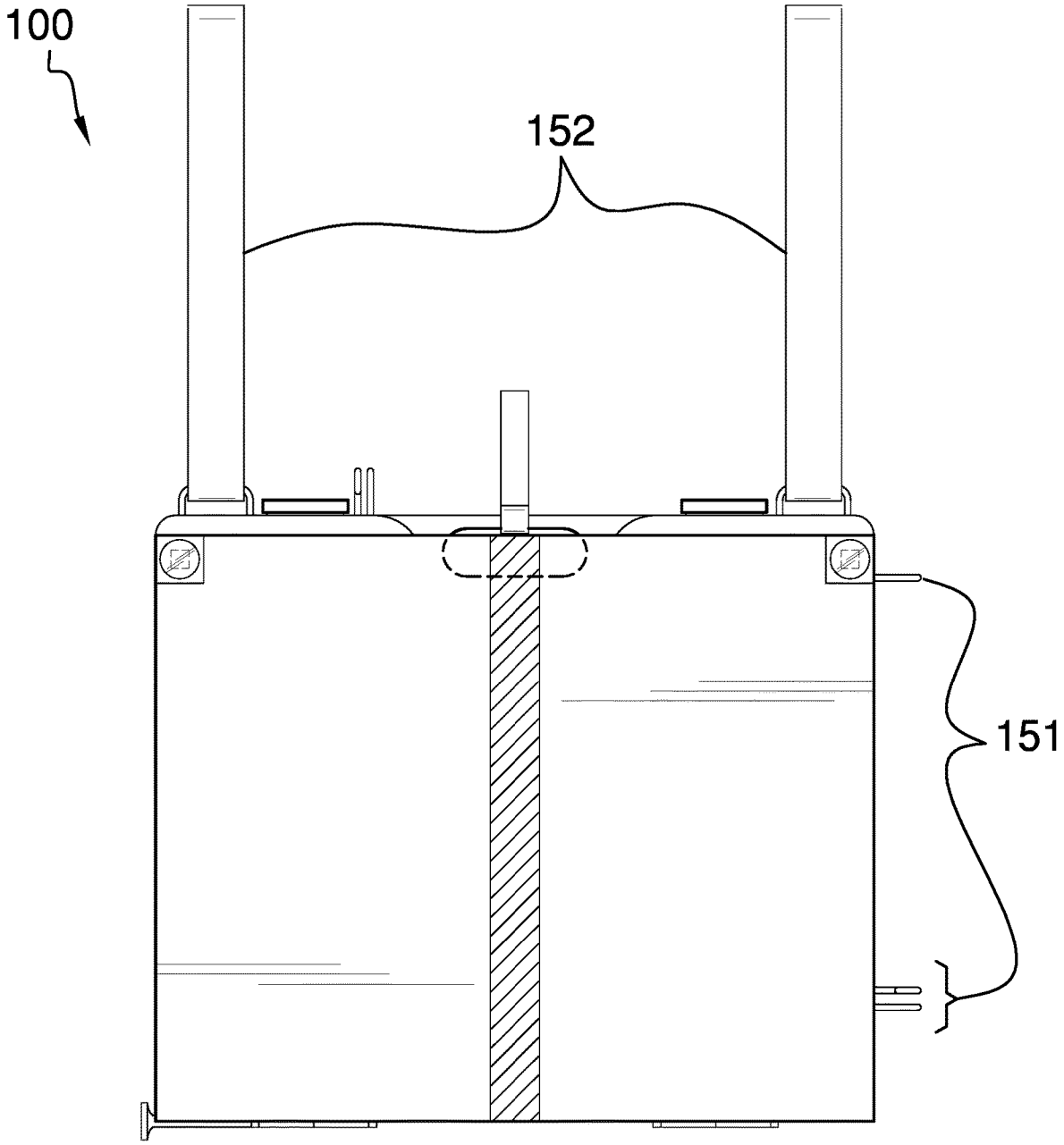
FIG. 5 is a closed top view of an embodiment of the disclosure.
Figure 6:
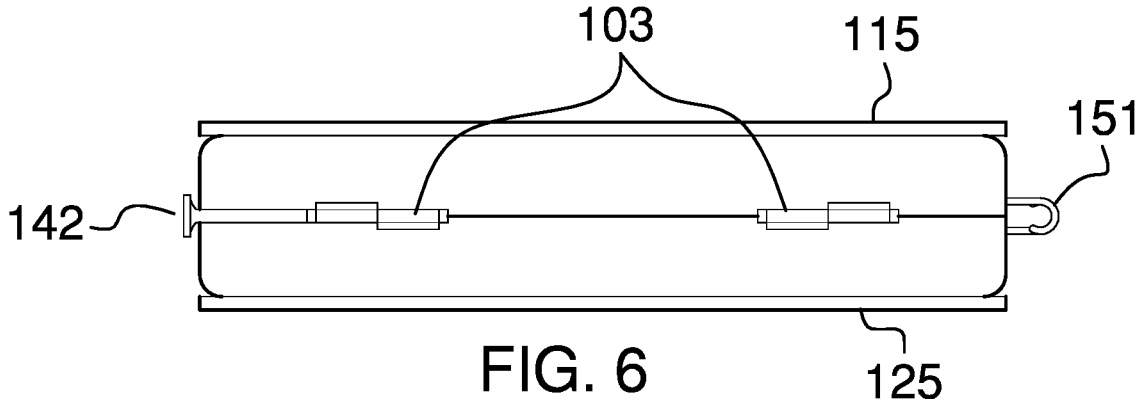
FIG. 6 is a closed front view of an embodiment of the disclosure.
Figure 7:
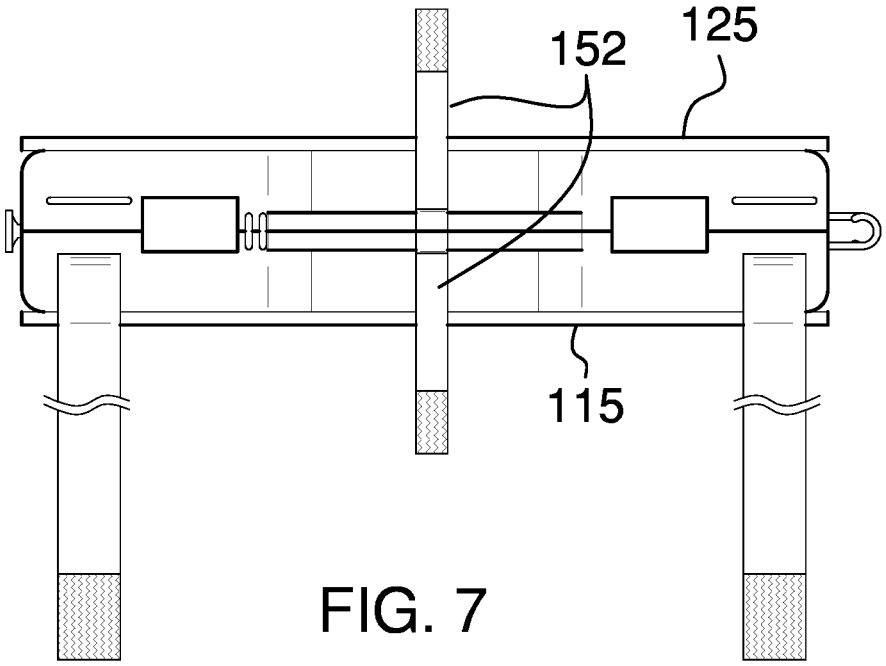
FIG. 7 is a closed bottom view of an embodiment of the disclosure.
Figure 8:
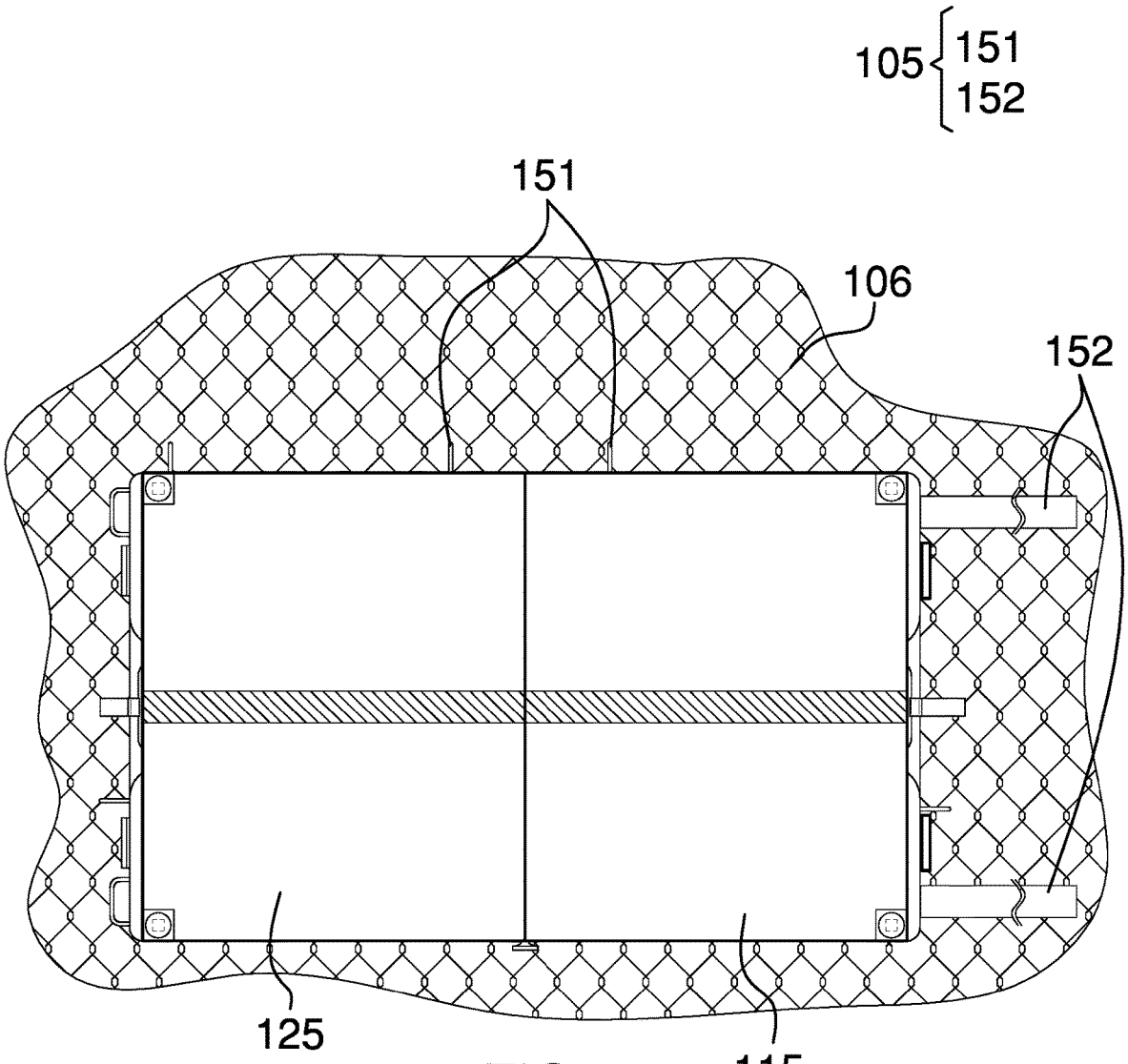
FIG. 8 is an in-use view of an embodiment of the disclosure.
Figure 9:
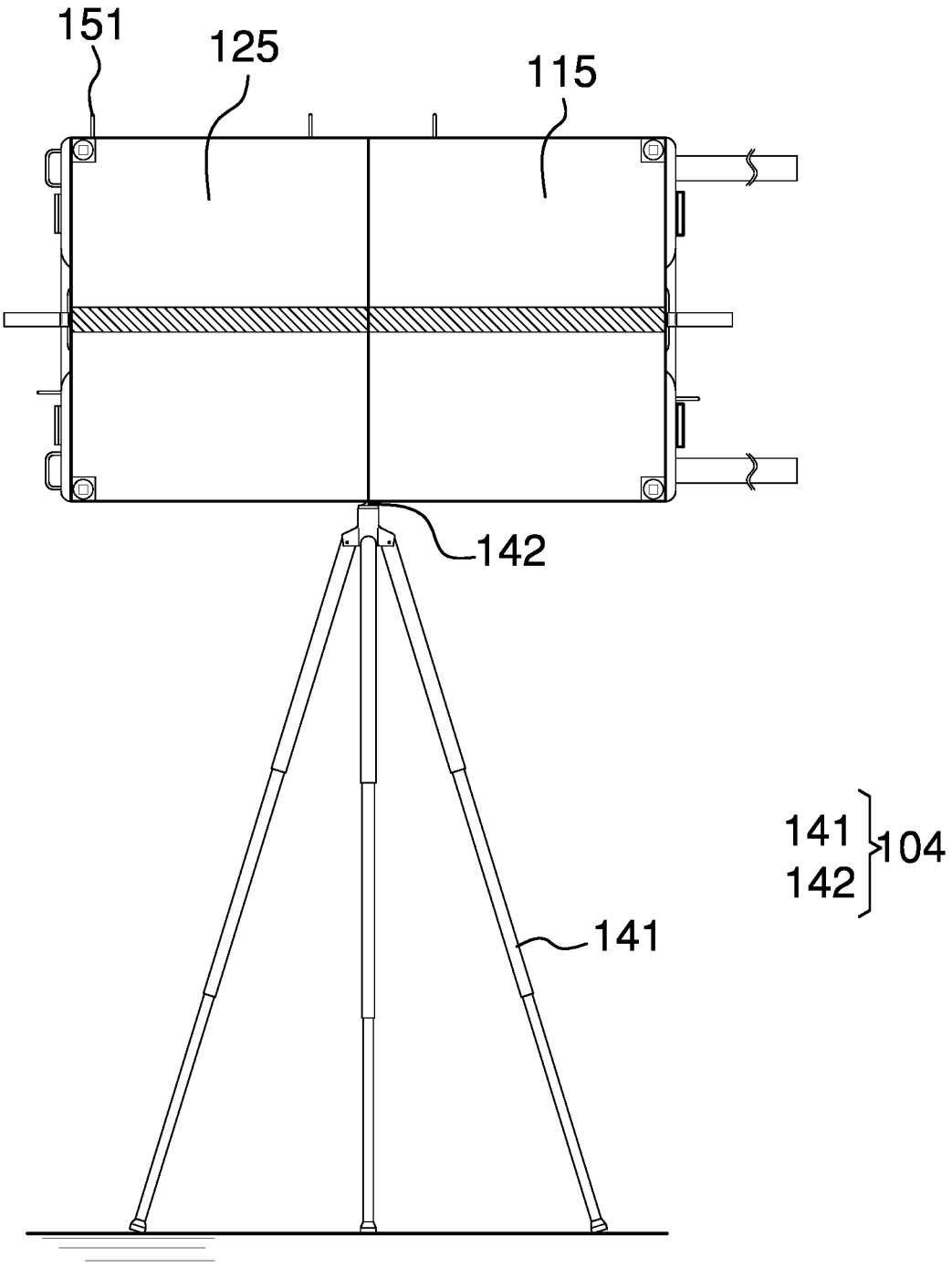
FIG. 9 is an in-use view of an embodiment of the disclosure.

Detailed reference will now be made to one or more potential embodiments of the disclosure, which are illustrated in FIGS. 1 through 9.

The pickle ball practice device 100 (hereinafter invention) is an item of sporting equipment. The invention 100 is configured for use with pickle ball. The invention 100 stores pickle ball equipment for transportation. The invention 100 forms a backboard used for physical training in the sport of pickle ball. The invention 100 comprises a pan structure 101, a lid structure 102, a hinge structure 103, a pedestal structure 104, and a fastening structure 105. The hinge structure 103 secures the pan structure 101 to the lid structure 102. The pedestal structure 104 elevates the pan structure 101 and the lid structure 102 to elevate the backboard structure formed by the invention 100. The fastening structure 105 secures the pan structure 101 and the lid structure 102 to a fence 106.

The fence 106 is a structure that encloses an area of pickle ball play. The fence 106 forms a vertically oriented boundary. The fence 106 forms an anchor point used by the fastening structure 105 to elevate the pan structure 101 and the lid structure 102 above the supporting surface.

The pan structure 101 is a prism-shaped structure. The pan structure 101 has a pan shape. The pan structure 101 is a hollow structure. The pan structure 101 forms a portion of the containment space formed by the invention 100. The pan structure 101 comprises a pan open face 111, a pan closed face 112, a plurality of pan lateral faces 113, and a pan insert 114.

The pan open face 111 is the open face of the pan shape of the pan structure 101. The pan insert 114 inserts into the pan structure 101 through the pan open face 111. The pan closed face 112 is the closed face of the pan shape of the pan structure 101. The pan closed face 112 is the face of the pan structure 101 that is distal from the pan open face 111. The pan backboard surface 115 attaches to the exterior surface of the pan closed face 112 of the pan structure 101.

The plurality of pan lateral faces 113 forms the boundary structure of the containment space of the pan structure 101 that is perpendicular to the pan closed face 112. The plurality of pan lateral faces 113 further comprises a first pan lateral face 161 and a second pan lateral face 162.

The second pan lateral face 162 is the lateral face selected from the plurality of pan lateral faces 113 that physically attaches to the lid structure 102. The hinge structure 103 attaches the second pan lateral face 162 to the second lid lateral face 182 of the lid structure 102. The first pan lateral face 161 is the lateral face selected from the plurality of pan lateral faces 113 that is distal from the second pan lateral face 162.

The pan insert 114 is a prism-shaped structure. The pan insert 114 is geometrically similar to the hollow interior of the pan structure 101. The pan insert 114 inserts into the pan structure 101. The pan insert 114 organizes the containment space of the pan structure 101. The pan insert 114 further comprises a plurality of pan recesses 171.

The plurality of pan recesses 171 comprises a plurality recesses formed with the pan insert 114. Each of the plurality of pan recesses 171 is geometrically similar to an object selected from the group consisting of: a) equipment used in the play of pickle ball; and, b) the pedestal structure 104. Each of the plurality of pan recesses 171 receives the selected object for storage within the invention 100. The plurality of pan recesses 171 comprises a pan racquet recess 172, a plurality of pan ball recesses 173, a pan tripod 141 recess 174, and a pan miscellaneous storage recess 175.

The pan racquet recess 172 is a recess selected from the plurality of pan recesses 171 that is configured to store a pickle ball racquet. The plurality of pan ball recesses 173 is a recess selected from the plurality of pan recesses 171 that is configured to store balls used in the play of pickle ball. The pan tripod 141 recess 174 is a recess selected from the plurality of pan recesses 171 that is configured to store the tripod 141. The pan miscellaneous storage recess 175 is a recess selected from the plurality of pan recesses 171 that is configured to store one or more personal items. The pan miscellaneous storage recess 175 further comprises a pan miscellaneous storage mesh 176. The pan miscellaneous storage mesh 176 is a textile based structure used to secure the one or more personal items in the plurality of pan recesses 171.

The pan backboard surface 115 is a disk-shaped structure. The pan backboard surface 115 is a rigid structure. The pan backboard surface 115 attaches to the exterior surface of the pan closed face 112 of the pan structure 101. The pedestal structure 104 elevates the pan backboard surface 115 above a supporting surface such that the pan backboard surface 115 will rebound a ball that strikes the pan backboard surface 115. The fastening structure 105 elevates the pan backboard surface 115 above a supporting surface such that the pan backboard surface 115 will rebound a ball that strikes the pan backboard surface 115. The pan backboard surface 115 combines with the lid backboard surface 125 to form a single planar backboard used for physical training purposes.

The lid structure 102 is a prism-shaped structure. The lid structure 102 has a pan shape. The lid structure 102 is a hollow structure. The lid structure 102 forms a portion of the containment space formed by the invention 100. The lid structure 102 is geometrically similar to the pan structure 101. The lid structure 102 attaches to the pan structure 101 such that the lid structure 102 rotates relative to the pan structure 101. The lid structure 102 attaches to the pan structure 101 such that the lid structure 102 encloses to the pan structure 101. The lid structure 102 latches to the pan structure 101 when the invention 100 is in the closed position. The lid structure 102 comprises a lid open face 121, a lid closed face 122, a plurality of lid lateral faces 123, and a lid insert 124.

The lid open face 121 is the open face of the pan shape of the lid structure 102. The lid insert 124 inserts into the lid structure 102 through the lid open face 121. The lid open face 121 is geometrically similar to the pan open face 111. The lid open face 121 is rotated against the pan open face 111 when the invention 100 is rotated into a closed position. The lid closed face 122 is the closed face of the pan shape of the lid structure 102. The lid closed face 122 is the face of the lid structure 102 that is distal from the lid open face 121. The lid backboard surface 125 attaches to the exterior surface of the lid closed face 122 of the lid structure 102.

The plurality of lid lateral faces 123 forms the boundary structure of the containment space of the lid structure 102 that is perpendicular to the lid closed face 122. The plurality of lid lateral faces 123 further comprises a first lid lateral face 181 and a second lid lateral face 182.

The second lid lateral face 182 is the lateral face selected from the plurality of lid lateral faces 123 that physically attaches to the pan structure 101. The hinge structure 103 attaches the second lid lateral face 182 to the second pan lateral face 162 of the pan structure 101. The first lid lateral face 181 is the lateral face selected from the plurality of lid lateral faces 123 that is distal from the second lid lateral face 182.

The lid insert 124 is a prism-shaped structure. The lid insert 124 is geometrically similar to the hollow interior of the lid structure 102. The lid insert 124 inserts into the lid structure 102. The lid insert 124 organizes the containment space of the lid structure 102. The lid insert 124 further comprises a plurality of lid recesses 191.

The plurality of lid recesses 191 comprises a plurality recesses formed with the lid insert 124. Each of the plurality of lid recesses 191 is geometrically similar to an object selected from the group consisting of: a) equipment used in the play of pickle ball; and, b) the pedestal structure 104. Each of the plurality of lid recesses 191 receives the selected object for storage within the invention 100. The plurality of lid recesses 191 are positioned within the lid insert 124 such that the plurality of lid recesses 191 aligns with the plurality of pan recesses 171 when the invention 100 is in the closed position. The plurality of lid recesses 191 comprises a lid racquet recess 192, a plurality of lid ball recesses 193, a lid tripod 141 recess 194, and a lid miscellaneous storage recess 195.

The lid racquet recess 192 is a recess selected from the plurality of lid recesses 191 that is configured to store a pickle ball racquet. The plurality of lid ball recesses 193 is a recess selected from the plurality of lid recesses 191 that is configured to store balls used in the play of pickle ball. The lid tripod 141 recess 194 is a recess selected from the plurality of lid recesses 191 that is configured to store the tripod 141. The lid miscellaneous storage recess 195 is a recess selected from the plurality of lid recesses 191 that is configured to store one or more personal items. The lid miscellaneous storage recess 195 further comprises a lid miscellaneous storage mesh 196. The lid miscellaneous storage mesh 196 is a textile based structure used to secure the one or more personal items in the plurality of lid recesses 191.

The lid backboard surface 125 is a disk-shaped structure. The lid backboard surface 125 is a rigid structure. The lid backboard surface 125 attaches to the exterior surface of the lid closed face 122 of the lid structure 102. The pedestal structure 104 elevates the lid backboard surface 125 above a supporting surface such that the lid backboard surface 125 will rebound a ball that strikes the lid backboard surface 125. The fastening structure 105 elevates the lid backboard surface 125 above a supporting surface such that the lid backboard surface 125 will rebound a ball that strikes the lid backboard surface 125. The lid backboard surface 125 combines with the pan backboard surface 115 to form a single planar backboard used for physical training purposes.

The hinge structure 103 is a mechanical structure. The hinge structure 103 is a rotating structure. The hinge structure 103 is a locking structure. The hinge structure 103 attaches the lid structure 102 to the pan structure 101 such that the lid structure 102 rotates relative to the pan structure 101. The hinge structure 103 rotates the lid structure 102 between an open position and a closed position. The hinge structure 103 attaches the second lid lateral face 182 of the lid structure 102 to the second pan lateral face 162 of the pan structure 101.

The pedestal structure 104 is a mechanical structure. The pedestal structure 104 is a load bearing structure. The pedestal structure 104 elevates the pan structure 101 and the lid structure 102 above a supporting surface. The pedestal structure 104 forms a load path that transfers the load of the pan structure 101 and the lid structure 102 to the supporting surface. The pedestal structure 104 is stored within the containment space formed by the pan structure 101 and the lid structure 102 when the pedestal structure 104 is not in use. The pedestal structure 104 elevates the backboard formed by the pan backboard surface 115 and the lid backboard surface 125 above the supporting surface. The elevation provided by the pedestal structure 104 is adjustable.

The pedestal structure 104 comprises a tripod 141 and a tripod 141 head 142. The tripod 141 is a load bearing structure. The pan structure 101 and the lid structure 102 physically attach to the tripod 141. The tripod 141 elevates the backboard formed by the pan backboard surface 115 and the lid backboard surface 125 above the supporting surface. The tripod 141 is an adjustable structure such that the elevation of the pan backboard surface 115 and the lid backboard surface 125 above the supporting surface is adjustable. The tripod 141 head 142 is a mechanical structure. The tripod 141 head 142 forms the superior structure of the tripod 141. The tripod 141 head 142 secures the pan structure 101 and the lid structure 102 to the tripod 141.

The fastening structure 105 is a fastening device. The fastening structure 105 attaches to the exterior surfaces of the pan structure 101 and the lid structure 102. The fastening structure 105 secures the pan structure 101 and the lid structure 102 to the fence 106. The fastening structure 105 elevates the backboard formed by the pan backboard surface 115 and the lid backboard surface 125 above the supporting surface. The fastening structure 105 comprises a plurality of hooks 151 and a plurality of hook and loop fasteners 152.

Each of the plurality of hooks 151 is a hook. Each of the plurality of hooks 151 attaches to a lateral face selected from a group consisting of: a) the plurality of pan lateral faces 113; and, b) the plurality of lid lateral faces 123. Each of the plurality of hooks 151 attaches the pan structure 101 and the lid structure 102 to the fence 106. The plurality of hooks 151 suspends the backboard formed by the pan backboard surface and the lid backboard surface 125 from the fence 106.

Each of the plurality of hook and loop fasteners 152 is a hook and loop fastener. Each of the plurality of hook and loop fasteners 152 attaches to a lateral face selected from a group consisting of: a) the plurality of pan lateral faces 113; and, b) the plurality of lid lateral faces 123. The plurality of hook and loop fasteners 152 secures the pan structure 101 and the lid structure 102 to the fence 106 such that the backboard formed by the pan backboard surface 115 and the lid backboard surface 125 remain firmly secured against the fence 106 such that the backboard does not bounce away from the fence 106.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Backboard: As used in this disclosure, a backboard is a rigid vertically oriented planar surface. The backboard deflects the direction of motion of a ball that strikes it in a direction selected from the group consisting of: a) back towards which the ball originally traveled; and, b) back into the field of play of a game.

Ball: As used in this disclosure, a ball refers to an object with a spherical or nearly spherical shape.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Closed Position: As used in this disclosure, a closed position refers to a rotating structure that is in an orientation that prevents access to the contents of the structure. The closed position is often referred to as an object being "closed."

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Fastener: As used in this disclosure, a fastener is a device that is used to join or affix two objects. Fasteners generally comprise a first element which is attached to the first object and a second element which is attached to the second object such that the first element and the second element join to removably attach the first object and the second object. Common fasteners include, but are not limited to, hooks, zippers, magnets, snaps, buttons, buckles, quick release buckles, or hook and loop fasteners. A fastener is often referred to as a fastening device.

Fence: As used in this disclosure, a fence is a barrier structure that encloses an outdoor space for the purposes of: 1) establishing a boundary; or, 2) controlling access into or out of the enclosed space. The boundary formed by a fence is referred to as a fence line.

Flap: As used in this disclosure, a flap is a sheeting or textile that is attached to a surface using one edge of the sheeting or textile such that the sheeting or textile rotates and hangs freely from the surface. The edge of the sheeting or textile that is distal from the secured edge is referred to as the free edge.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hang: As used in this disclosure, to hang an object is to suspend an object above a surface from above such that the inferior end of the object does not form a significant portion of the load path of the object.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Lamp: As used in this disclosure, a lamp is an electrical device that generates visible light to illuminate objects so they can be seen.

Latch: As used in this disclosure, a latch is a fastening or locking mechanism commonly used to secure a lid, a door, or, a gate.

Lid: As used in this disclosure, a lid is a removable cover that is placed over an opening of a hollow structure to enclose the hollow structure.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Mesh: As used in this disclosure, the term mesh refers to an openwork fabric made from threads, yarns, cords, wires, or lines that are woven, knotted, or otherwise twisted or intertwined at regular intervals. Synonyms for mesh include net. A mesh structure formed from metal bars or wires is often referred to as a grate.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a rotating structure that is in an orientation that allows access to the contents of the structure. The open position is often referred to as an object being "open."

Orientation: As used in this disclosure, orientation refers to the positioning of a first object relative to: 1) a second object; or, 2) a fixed position, location, or direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Pedestal: As used in this disclosure, a pedestal is an intermediary load bearing structure that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Pocket: As used in this disclosure, a pocket is a storage space that is formed on or into an object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Racquet: As used in this disclosure, a racquet is a tool that is used to exchange momentum between an individual using the racquet and an object such as a ball. A racquet is used in games such as tennis, badminton, and squash. The racquet comprises a head and a handle. The handle is a grip used to carry and manipulate the head. The head is the working element of the tool formed by the racquet. The head forms a surface that transfers momentum from the individual using the racquet to the object. The racquet is typically a loop shaped structure. A plurality of cords are attached under tension (commonly referred to as "strung") to the head such that plurality of cords forms the striking surface that transfers momentum from the individual using the racquet to the object. Alternately, the racquet can be a solid surface that transfers momentum from the individual using the racquet to the object.

Recess: As used in this disclosure, a recess is a negative space that is formed in a surface. The recess is sized to receive an object such that the object is below the plane of the surface in which the recess is formed.

Rigid Structure: As used in this disclosure, a rigid structure is a solid structure formed from an inelastic material that resists changes in shape. A rigid structure will permanently deform as it fails under a force. See bimodal flexible structure.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object. Include inferior superior and load path.

Tension: As used in this disclosure, tension refers to a force applied to an object such that the force will stretch the span of length of the object along the direction of the force.

Textile: As used in this disclosure, a textile is a material that is woven, knitted, braided or felted. Synonyms in common usage for this definition include fabric and cloth. The two surfaces of the textile with the greatest surface area are called the faces of the textile.

Tool: As used in this disclosure, a tool is a device, an apparatus, or an instrument that is used to carry out an activity, operation, or procedure.

Tripod: As used in this disclosure, a tripod is a three legged structure that forms a load path.

Tripod Head: As used in this disclosure, a tripod head is the portion of the tripod that is attached to a load that is elevated by the tripod. Modern tripod heads incorporate a ball head design that allows the orientation of the load to be adjusted and then locked into position. Tripod heads further comprise a standardized tripod port which is a standardized threaded connection that is used to connect the load to the tripod head.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The shape of a webbing is approximated by a rectangular disk shape. The two surfaces of a webbing with the greatest surface area are called the faces of the webbing.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A pickle ball practice device comprising a pan structure, a lid structure, a hinge structure, a pedestal structure, and a fastening structure;

wherein the hinge structure secures the pan structure to the lid structure;

wherein the pedestal structure elevates the pan structure and the lid structure to elevate a backboard structure formed by the pickle ball practice device;

wherein the fastening structure secures the pan structure and the lid structure to a fence;

wherein the pan structure comprises a pan open face, a pan closed face, a plurality of pan lateral faces, and a pan insert;

wherein the pan open face is the open face of the pan shape of the pan structure;

wherein the pan insert inserts into the pan structure through the pan open face;

wherein the pan closed face is the closed face of the pan shape of the pan structure;

wherein the pan closed face is the face of the pan structure that is distal from the pan open face;

wherein a pan backboard surface attaches to an exterior surface of the pan closed face of the pan structure;

wherein the plurality of pan lateral faces forms a boundary structure of a containment space of the pan structure that is perpendicular to the pan closed face.

2. The pickle ball practice device according to claim 1 wherein the pickle ball practice device is configured for use with the game of pickle ball;

wherein the pickle ball practice device stores pickle ball equipment for transportation;

wherein the pickle ball practice device forms a backboard used for physical training in the sport of pickle ball;

wherein the fence is a structure that encloses an area of pickle ball play;

wherein the fence forms a vertically oriented boundary;

wherein the fence forms an anchor point used by the fastening structure to elevate the pan structure and the lid structure above the supporting surface.

3. The pickle ball practice device according to claim 2
wherein the pan structure is a prism-shaped structure;
wherein the pan structure has a pan shape;
wherein the pan structure is a hollow structure;
wherein the pan structure forms a portion of the containment space formed by the pickle ball practice device.

4. The pickle ball practice device according to claim 3
Wherein the pan insert is a prism-shaped structure;
wherein the pan insert is geometrically similar to a hollow interior of the pan structure;
wherein the pan insert inserts into the pan structure;
wherein the pan insert organizes the containment space of the pan structure.

5. The pickle ball practice device according to claim 4
wherein the lid structure is a prism-shaped structure;
wherein the lid structure has a pan shape;
wherein the lid structure is a hollow structure;
wherein the lid structure forms a portion of the containment space formed by the pickle ball practice device;
wherein the lid structure is geometrically similar to the pan structure;
wherein the lid structure attaches to the pan structure such that the lid structure rotates relative to the pan structure;
wherein the lid structure attaches to the pan structure such that the lid structure encloses to the pan structure;
wherein the lid structure latches to the pan structure when the pickle ball practice device is in the closed position.

6. The pickle ball practice device according to claim 5
wherein the hinge structure is a mechanical structure;
wherein the hinge structure is a rotating structure;
wherein the hinge structure is a locking structure;
wherein the hinge structure attaches the lid structure to the pan structure such that the lid structure rotates relative to the pan structure;
wherein the hinge structure rotates the lid structure between an open position and a closed position;
wherein the hinge structure attaches a second lid lateral face of the lid structure to a second pan lateral face of the pan structure.

7. The pickle ball practice device according to claim 6
wherein the pedestal structure is a mechanical structure;
wherein the pedestal structure is a load bearing structure;
wherein the pedestal structure elevates the pan structure and the lid structure above a supporting surface;
wherein the pedestal structure forms a load path that transfers the load of the pan structure and the lid structure to the supporting surface;
wherein the pedestal structure is stored within the containment space formed by the pan structure and the lid structure when the pedestal structure is not in use;
wherein the pedestal structure elevates the backboard formed by the pan backboard surface and the lid backboard surface above the supporting surface;
wherein the elevation provided by the pedestal structure is adjustable.

8. The pickle ball practice device according to claim 7
wherein the fastening structure is a fastening device;
wherein the fastening structure attaches to the exterior surfaces of the pan structure and the lid structure;
wherein the fastening structure secures the pan structure and the lid structure to the fence;
wherein the fastening structure elevates the backboard formed by the pan backboard surface and the lid backboard surface above the supporting surface.

9. The pickle ball practice device according to claim 8
wherein the lid structure comprises a lid open face, a lid closed face, a plurality of lid lateral faces, and a lid insert;
wherein the lid open face is the open face of the pan shape of the lid structure;
wherein the lid insert inserts into the lid structure through the lid open face;
wherein the lid open face is geometrically similar to the pan open face;
wherein the lid open face is rotated against the pan open face when the pickle ball practice device is rotated into a closed position;
wherein the lid closed face is the closed face of the pan shape of the lid structure;
wherein the lid closed face is the face of the lid structure that is distal from the lid open face;
wherein the lid backboard surface attaches to the exterior surface of the lid closed face of the lid structure;
wherein the plurality of lid lateral faces forms the boundary structure of the containment space of the lid structure that is perpendicular to the lid closed face.

10. The pickle ball practice device according to claim 9
wherein the pan insert further comprises a plurality of pan recesses;
wherein the plurality of pan recesses comprises a plurality recesses formed with the pan insert;
wherein each of the plurality of pan recesses is geometrically similar to an object selected from the group consisting of: a) equipment used in the play of pickle ball; and, b) the pedestal structure;
wherein each of the plurality of pan recesses receives the selected object for storage within the pickle ball practice device;
wherein the pan backboard surface is a disk-shaped structure;
wherein the pan backboard surface is a rigid structure;
wherein the pan backboard surface attaches to the exterior surface of the pan closed face of the pan structure.

11. The pickle ball practice device according to claim 10
wherein the lid insert is a prism-shaped structure;
wherein the lid insert is geometrically similar to the hollow interior of the lid structure;
wherein the lid insert inserts into the lid structure;
wherein the lid insert organizes the containment space of the lid structure;
wherein the lid insert further comprises a plurality of lid recesses;
wherein the plurality of lid recesses comprises a plurality recesses formed with the lid insert;
wherein each of the plurality of lid recesses is geometrically similar to an object selected from the group consisting of: a) equipment used in the play of pickle ball; and, b) the pedestal structure;
wherein each of the plurality of lid recesses receives the selected object for storage within the pickle ball practice device;
wherein the lid backboard surface is a disk-shaped structure;
wherein the lid backboard surface is a rigid structure;
wherein the lid backboard surface attaches to the exterior surface of the lid closed face of the lid structure.

12. The pickle ball practice device according to claim 11
wherein the pedestal structure elevates the pan backboard surface above a supporting surface such that the pan backboard surface will rebound a ball that strikes the pan backboard surface;

wherein the fastening structure elevates the pan backboard surface above a supporting surface such that the pan backboard surface will rebound a ball that strikes the pan backboard surface;

wherein the pedestal structure elevates the lid backboard surface above a supporting surface such that the lid backboard surface will rebound a ball that strikes the lid backboard surface;

wherein the fastening structure elevates the lid backboard surface above a supporting surface such that the lid backboard surface will rebound a ball that strikes the lid backboard surface;

wherein the lid backboard surface combines with the pan backboard surface to form a single planar backboard.

13. The pickle ball practice device according to claim 12 wherein the plurality of pan recesses comprises a pan racquet recess, a plurality of pan ball recesses, a pan tripod recess, and a pan miscellaneous storage recess;

wherein the pan racquet recess is a recess selected from the plurality of pan recesses that is configured to store a pickle ball racquet;

wherein the plurality of pan ball recesses is a recess selected from the plurality of pan recesses that is configured to store balls used in the play of pickle ball;

wherein the pan tripod recess is a recess selected from the plurality of pan recesses that is configured to store the tripod;

wherein the pan miscellaneous storage recess is a recess selected from the plurality of pan recesses that is configured to store one or more personal items;

wherein the pan miscellaneous storage recess further comprises a pan miscellaneous storage mesh;

wherein the pan miscellaneous storage mesh is a textile based structure used to secure the one or more personal items in the plurality of pan recesses.

14. The pickle ball practice device according to claim 13 wherein the plurality of lid recesses comprises a lid racquet recess, a plurality of lid ball recesses, a lid tripod recess, and a lid miscellaneous storage recess;

wherein the lid racquet recess is a recess selected from the plurality of lid recesses that is configured to store a pickle ball racquet;

wherein the plurality of lid ball recesses is a recess selected from the plurality of lid recesses that is configured to store balls used in the play of pickle ball;

wherein the lid tripod recess is a recess selected from the plurality of lid recesses that is configured to store the tripod;

wherein the lid miscellaneous storage recess is a recess selected from the plurality of lid recesses that is configured to store one or more personal items;

wherein the lid miscellaneous storage recess further comprises a lid miscellaneous storage mesh;

wherein the lid miscellaneous storage mesh is a textile based structure used to secure the one or more personal items in the plurality of lid recesses.

* * * * *